US007225950B2

(12) United States Patent
McKay

(10) Patent No.: US 7,225,950 B2
(45) Date of Patent: Jun. 5, 2007

(54) LINT ROLL/DISPENSABLE FLUID CONTAINER APPARATUS

(75) Inventor: William D. McKay, Grand Blanc, MI (US)

(73) Assignee: The Hartz Mountain Corporation, Secaucus, NJ (US)

( * ) Notice: Subject to any disclaimer, the term of this patent is extended or adjusted under 35 U.S.C. 154(b) by 547 days.

(21) Appl. No.: 10/813,985

(22) Filed: Mar. 31, 2004

(65) Prior Publication Data

US 2004/0182886 A1 Sep. 23, 2004

Related U.S. Application Data

(63) Continuation-in-part of application No. 10/329,717, filed on Dec. 26, 2002, now Pat. No. 7,039,982, and a continuation-in-part of application No. 10/302,038, filed on Nov. 22, 2002, now Pat. No. 6,763,977, which is a continuation-in-part of application No. 10/143,396, filed on May 10, 2002, now Pat. No. 6,698,626.

(60) Provisional application No. 60/426,589, filed on Nov. 15, 2002.

(51) Int. Cl.
*B67D 1/07* (2006.01)

(52) U.S. Cl. ..... 222/192; 15/104.002; 15/105; 15/230.11

(58) Field of Classification Search ..... 222/192; 15/104.002, 104.94, 105, 118, 230.11
See application file for complete search history.

(56) References Cited

U.S. PATENT DOCUMENTS

| | | | | |
|---|---|---|---|---|
| 1,039,333 | A * | 9/1912 | Swanson | 15/185 |
| 2,401,842 | A * | 6/1946 | Slater | 15/104.002 |
| 3,011,499 | A | 12/1961 | Tajan | 401/139 |
| 3,056,154 | A | 10/1962 | Neal | 15/104 |
| 3,102,544 | A | 9/1963 | Keegan et al. | 132/147 |
| 3,158,887 | A | 12/1964 | Kanbar et al. | 15/104 |
| 3,299,461 | A | 1/1967 | Marks | 15/104 |
| 3,373,457 | A | 3/1968 | Rouch, Jr. | 15/104 |
| 3,665,543 | A | 5/1972 | Nappi | 15/215 |
| 4,062,083 | A | 12/1977 | McKay | 15/106 |
| 4,107,811 | A | 8/1978 | Imsande | 15/215 |
| 4,244,587 | A | 1/1981 | Schweizer | 15/104.8 |
| 4,361,923 | A | 12/1982 | McKay | 15/104 |
| 4,399,579 | A | 8/1983 | McKay | 15/104 |
| 4,422,201 | A | 12/1983 | McKay | 15/104 |
| 4,727,616 | A | 3/1988 | Kucera et al. | 15/104 |
| 4,742,547 | A | 5/1988 | Watanabe | 15/104 |
| 4,850,073 | A | 7/1989 | Preuss | 15/207.2 |
| 4,905,337 | A | 3/1990 | McKay | 15/104 |
| 5,027,465 | A | 7/1991 | McKay | 15/104 |
| D320,680 | S | 10/1991 | Stetson et al. | D30/158 |
| D342,610 | S | 12/1993 | Stetson et al. | D4/122 |
| D363,214 | S | 10/1995 | Parola et al. | D9/300 |
| 5,746,531 | A * | 5/1998 | Izhak | 401/139 |
| 5,819,989 | A | 10/1998 | Saraceni | 221/192 |
| 5,878,457 | A | 3/1999 | Cox et al. | 15/104.002 |

(Continued)

*Primary Examiner*—Frederick C. Nicolas
(74) *Attorney, Agent, or Firm*—Gottlieb, Rackman & Reisman

(57) ABSTRACT

A lint roller dispensable fluid container apparatus includes a support for mounting a lint roll on a dispensable fluid container. The support may be a hollow tubular member rotatably carrying the lint roll and which is releasably mountable over one end of the container. The support may also be formed on the container cap which covers a discharge nozzle or outlet in the cap.

8 Claims, 7 Drawing Sheets

U.S. PATENT DOCUMENTS 6,014,788 A 1/2000 Jaffri ..... 15/104.002
6,055,695 A 5/2000 McKay, Jr. ..... 15/104.002
6,127,014 A 10/2000 McKay, Jr. ..... 428/43
6,298,517 B1 10/2001 McKay ..... 15/228
6,325,070 B1 12/2001 Tyroler et al. ..... 132/112
6,688,464 B2 * 2/2004 Jessen et al. ..... 206/349
6,698,626 B2 * 3/2004 McKay ..... 222/192
6,763,977 B2 * 7/2004 McKay ..... 222/192

* cited by examiner

LINT ROLL/DISPENSABLE FLUID CONTAINER APPARATUS

CROSS REFERENCE TO CO-PENDING APPLICATIONS

This application is a continuation-in-part of application Ser. No. 10/329,717, filed Dec. 26, 2002 now U.S. Pat. No. 7,039,982, which claims the benefit of the priority filing date of U.S. Provisional Application Ser. No. 60/426,589, filed Nov. 15, 2002, and which is also a continuation-in-part of U.S. application Ser. No. 10/302,038, filed Nov. 22, 2002 now U.S. Pat. No. 6,763,977, which is a continuation-in-part of U.S. patent application Ser. No. 10/143,396, filed May 10, 2002, now U.S. Pat. No. 6,698,626, the contents of all of which are incorporated herein in their entirety.

BACKGROUND

The present invention relates to cleaning apparatus for removing debris or dirt from surfaces and, more particularly, to lint roller assemblies.

There are many previously known lint roller assemblies. These previously known lint roller assemblies typically comprise a handle secured to a cylindrical lint roller support. A tubular cylindrical adhesive lint roller is then removably mounted to the support such that the adhesive roller is rotatable relative to the handle. In use, the adhesive lint roller is rolled along a surface to remove unsightly particles, lint, pet hair, etc.

The previously known lint roller assemblies have used a number of different options to rotatably secure the lint roller support to the handle. For example, in U.S. Pat. No. 4,361,923, the lint roller support and handle are separately constructed and then rotatably secured together. One disadvantage of this type of previously known lint roller assembly, however, is that the rotatably connection between the handle and lint roller support is subject to mechanical failure. Another drawback is that a directional lint fabric cannot be attached to the rotatable support section and still be operable. It rotates with the support and is not stationary to provide for brushing motion.

A further disadvantage to this type of assembly is that both the lint roller support and the handle are separately molded from plastic and then assembled together requiring two separate molds, one for each part.

Still other types of lint roller assemblies, such as that disclosed in U.S. Pat. No. 6,055,695, the lint roller handle includes a pair of elongated housing parts, which are substantially identical to each other. A disadvantage to this type of assembly is that each housing part must be snapped exactly into the other perfectly registering using pins and sockets. A further disadvantage is that the handle section being integral to the support section is manufactured with rigid plastic material and uncomfortable to grip and does not provide for a customized plastic decorative top or hanger.

Still other types of previously known lint roller assemblies, such as that disclosed in U.S. Pat. No. 4,5577,0111, utilize a unitary lint roller handle and lint roller support. These previously known lint roller assemblies, however, require a complex and, therefore, expensive mold design in order to mold the lint roller handle and support. Furthermore, a relatively large frictional engagement between the lint roller and the lint roller support often times interferes with the desired free rotation of the lint roller about the lint roller support.

SUMMARY

The present invention is a cleaning apparatus which addresses the abovementioned disadvantages of the previously known art.

In many cleaning situations, the removal of dirt or debris can be made more efficient by the application of a liquid cleaner to the surface being cleaned. Aerosol or pump containers are widely employed to dispense cleaning fluid in a spray onto a surface to be cleaned.

Thus, it would be desirable to provide the cleaning ability of an adhesive lint roller with the cleaning ability of a liquid spray for enhanced cleaning capability.

In one aspect of the invention, a lint roller/fluid dispenser apparatus includes a container containing a fluid dispensable from the container, a lint roll having an adhesive outer surface, and means for mounting the lint roll on the container.

The mounting means may be a hollow support, having an inner bore open from one end. The bore has a diameter for slidably receiving one end portion of the container therein. One end of the container projects outwardly from the support, after the container is mounted in the support, to act as a handle for use of the lint roll.

Means are also provided for rotatably mounting the lint roll on the support. In one aspect, the rotatable mounting means is a pair of spaced bearing surfaces formed on the support, the lint roll rotatably mounted on the bearing surfaces.

In another aspect, the mounting means includes a first collar mountable on the container at an intermediate position spaced from one end of the container, and at least one projection carried on the end of the container and spaced from the first collar. The lint roll is mounted between the projection and the first collar over the container.

In another aspect, the mounting means is a spindle having opposed first and second end collars, and at least one of the first and second end collars having a through aperture for mounting of the spindle over a portion of the container.

In another aspect, the mounting means includes a tubular support, means, carried on the support, for rotatably mounting the lint roll on the support, and means, carried on the support, for releasibly mounting one end of the support to the container.

In another aspect, a cap is mountable over a discharge end of the container, and means, carried on the cap, are provided for supporting the lint roll on the cap.

The supporting means may be a pair of spaced arms carried on the cap, the lint roll rotatably disposed between the pair of arms.

In another aspect, a discharge nozzle is carried on one end of the container. The mounting means includes a support mounted on one end of the container. A pair of arms projecting from the support and rotatably carrying the lint roll therebetween. An aperture is formed in the support adjacent to the discharge nozzle to allow dispensing of the contents of the container through the discharge nozzle and the support.

The unique lint roll/fluid dispensable container apparatus of the present invention uniquely combines an adhesive faced lint roll with a dispensable fluid container to enable a dispensable fluid, such as a cleaning fluid, to be dispensed over a surface to be cleaned prior to or at the same time that the outer adhesive surface of the lint roll is being moved across the surface to enhance the cleaning and removal of dirt, debris and hair from the surface. The invention utilizes a plurality of different unique support means for rotatably mounting the lint roll on the container or on a cap releasably mountable over the discharge outlet or nozzle of the container. Substantially of these supports do not require modification to existing container designs.

BRIEF DESCRIPTION OF THE DRAWING

The various features, advantages and other uses of the present invention will become more apparent by referring to the following detailed description and drawing in which.

DETAILED DESCRIPTION

Figure 1:
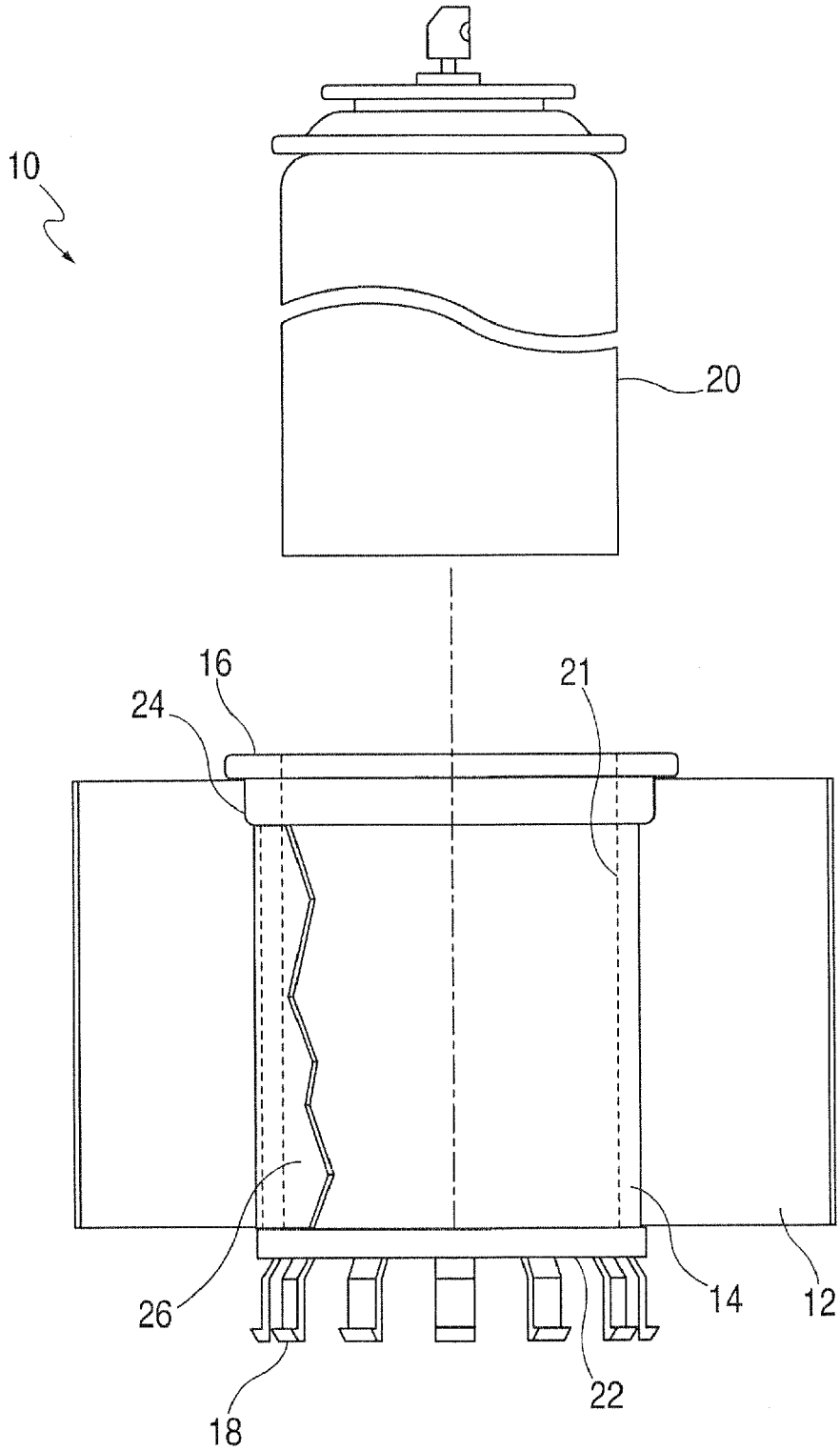
FIG. 1 is an exploded, side elevational view of one aspect of the present invention.
Figure 2:
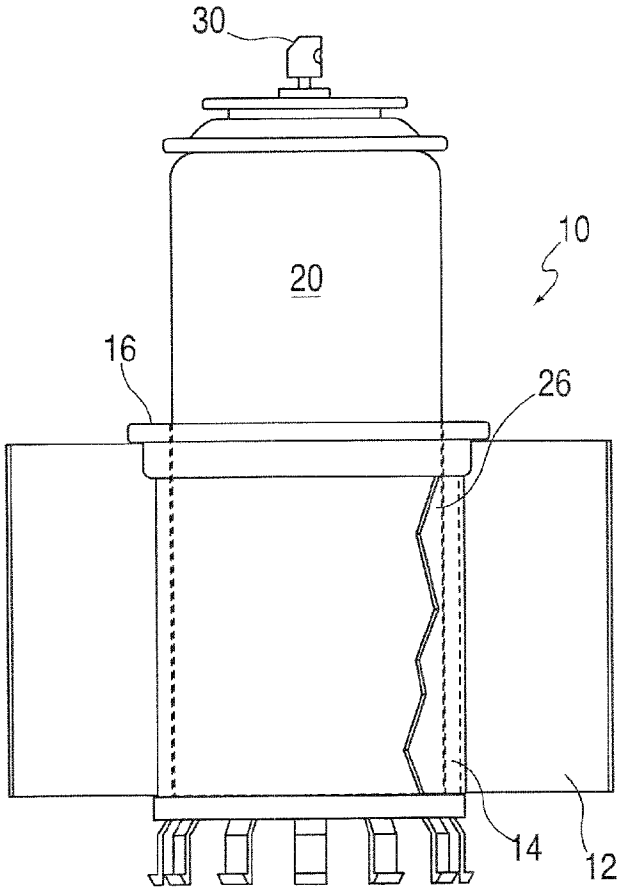
FIG. 2 is a side elevational view showing the assembled apparatus of FIG. 1.

Referring now to FIGS. 1 and 2, there is depicted a lint roller container assembly 10 constructed in accordance with the teachings of one aspect of the present invention.

A tape roll 12 may be any commercially available tape roll having outwardly facing adhesive sheets or strips, generally arranged in a plurality of sheets wound in a roll wherein the outermost sheets are peelable from the roll, one at a time, along perforated edges of each sheet. The tape roll 12 is mounted on a support 14 in the form of a plastic or other suitable material, cylindrically shaped tubular member having an enlarged flange 16 at one end and one or more projections 18 at a second end. The support 14 is hollow and has an inner diameter sized to snugly, but releasibly received an aerosol or pump spray can 20 having a complementary outer diameter.

The support 14 is formed with first and second bearing surfaces 22 and 24, at opposite ends which rotatably support a lint roll 12. Further, a directional fabric 26 may be mounted between the bearing surfaces 22 and 24 on the cylindrical portion of the support 14.

As shown in FIG. 2, the can 20 is inserted into the hollow interior 21 of the support 14. The can 20 preferably has a length sufficient so that one end of the can projects outwardly from the flange 16 on the support 14 so as to function as a handle during use of the tape roll 12.

It can be seen in FIG. 2, that the spray nozzle 30 of the aerosol can 20 can be used independent of the tape roll 12.

Figure 3:
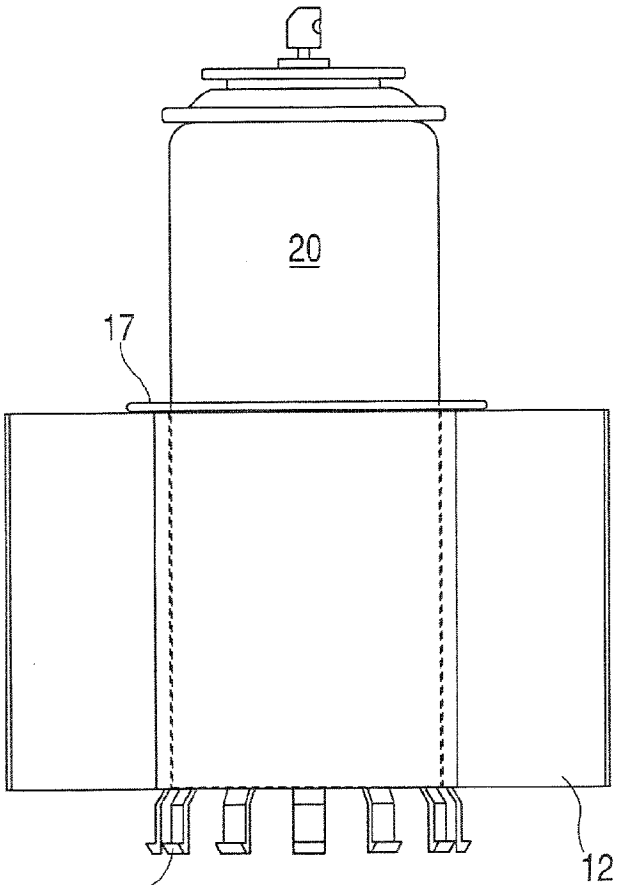
FIG. 3 is a side elevational view of a modified apparatus similar to FIGS. 1 and 2.

In a modification shown in FIG. 3, the directional fabric 26 is eliminated along with the first and second bearing surfaces 22 and 24. In this aspect of the invention, the tape roll 12 rotates about the outer surface of the can 20 between a first collar 17 and a second collar 19 which are mounted on or formed on the can 20. The collars 17 and 19 trap the roll 12 from axial movement.

Figure 4:
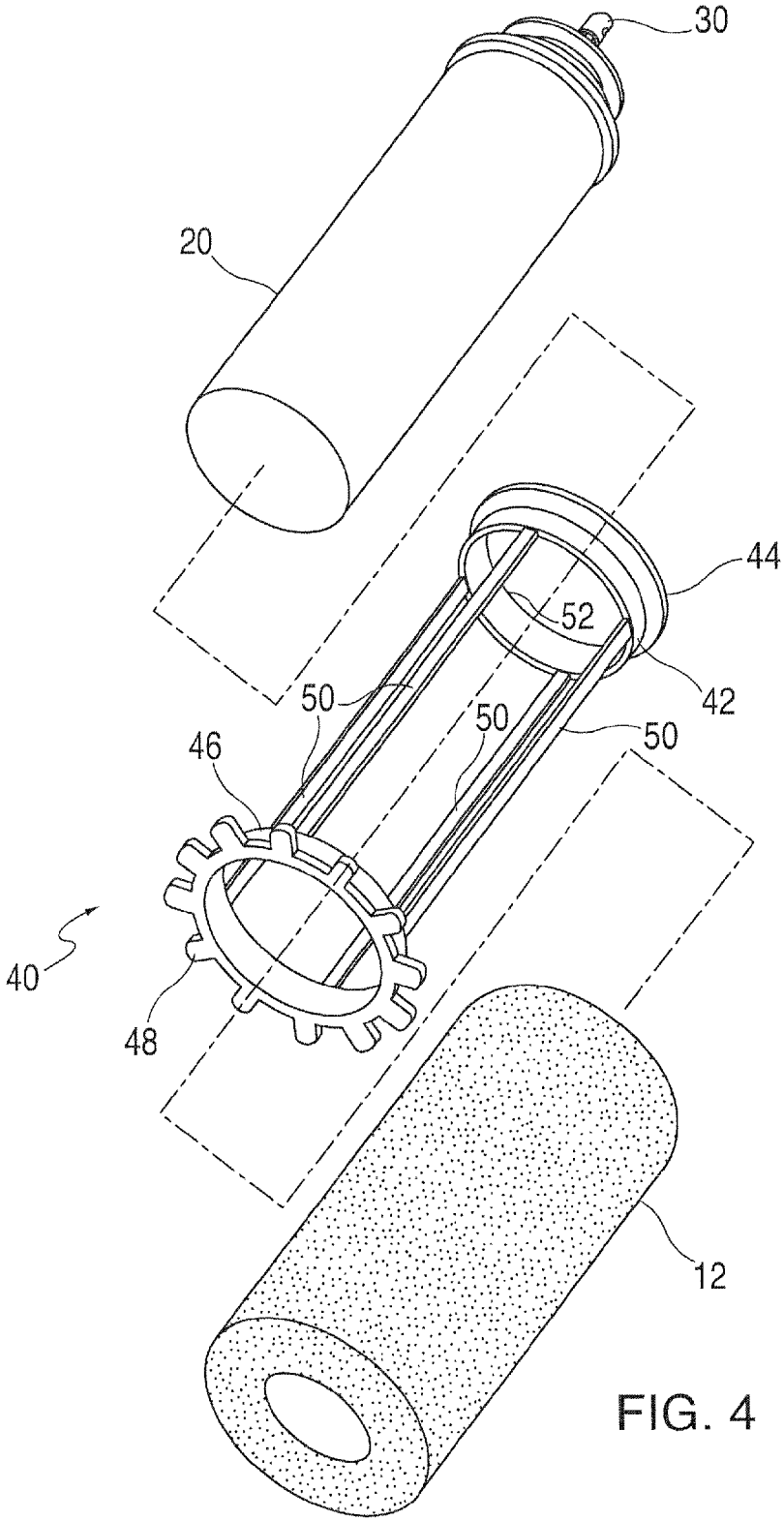
FIG. 4 is an exploded, perspective view of another aspect of the present invention.

FIG. 4 depicts an alternate support 40 in the form of a cylindrical spindle. The support 40 includes a first collar 42 having an enlarged diameter flange 44 at one end. The opposite end of the support 40 defines a second collar 46 having a plurality of radially extending projections 48 extending therefrom. The collars 42 and 46 are rigidly interconnected by means of a plurality of slats 50.

The lint roll 12 is forced over the projections 48 and onto the first and second collars 42 and 46 wherein it is capable of rotation. The enlarged diameter end 44 and the projections 48 axially trap the lint roll 12 on the support 40.

An aperture 52 is formed in the flange 44 and is sized to snugly receive the outer diameter of the can 20. One end of the can 20 extends outwardly from the flange 44 after the can 20 has been fully inserted into the support 40, in much the same manner as shown in FIG. 2, to enable the exposed end of the can 20 to act as a handle for the lint roll 12.

Figure 6:
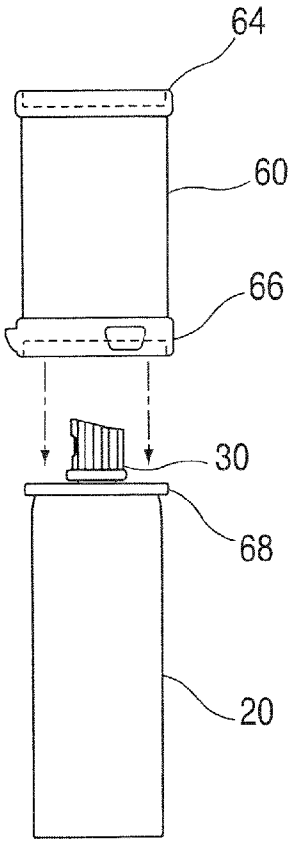
FIGS. 5 and 6 are exploded, side elevational views showing other aspects of the present invention.
Figure 5:
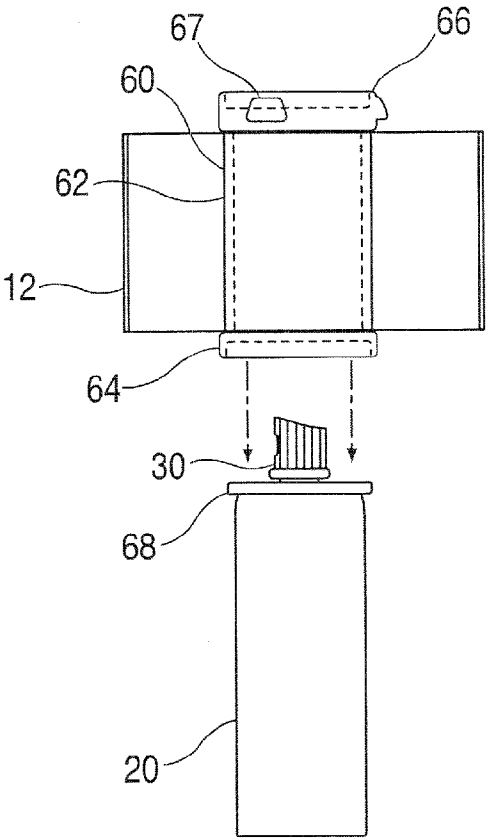

Referring now to FIGS. 5 and 6, there is depicted other aspects of the present invention in which a lint roll is rotatably mounted on an can 20. As shown in FIG. 5, a lint roll support 60 is in the form of a hollow, cylindrical body formed of a suitable plastic for example only. The support 60 includes a bearing surface 62 located between two enlarged collars 64 and 66 formed at opposite ends of the support 60. The collars 64 and 66 axially trap a lint roll 12 therebetween for rotation of the lint roll 12 about the bearing surface 62 of the support 60.

The collar 64 has an open ended recess which is releasibly engagable via a snap-on fit with a flange 68 formed at one end of the aerosol can 20 immediately adjacent the nozzle 30. In this manner, the support 60 may be snapped onto the aerosol can 20 for use of the lint roll 12. When it is desired to dispense the contents of the can 20 through the nozzle 30, the support 60 is removed from the aerosol can 20.

In FIG. 6, the axial orientation of the support 60 is reversed from that shown in FIG. 5 in that the collar 66, which also has an open ended recess, is releasibly engaged with flange 68 on the aerosol can 20.

Figure 7:
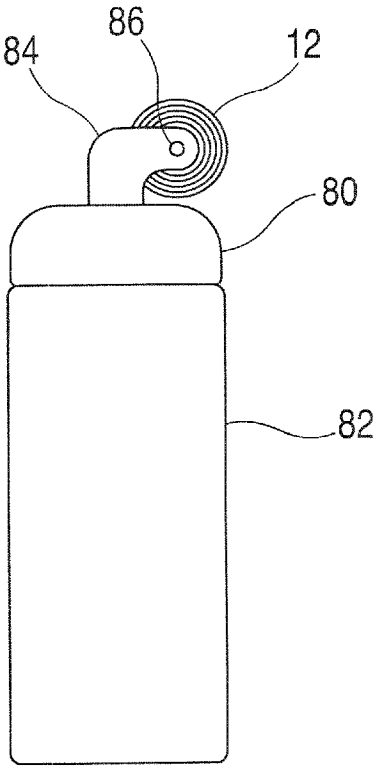

Referring now to FIG. 7, there is depicted another aspect of the present invention in which a lint roll 12 is mounted on a cap 80 releasibly mountable over the discharge nozzle of an aerosol can or pump dispenser container 82.

The lint roll 12 is supported by a pair of arms 84 which are attached to or integrally molded on the cap 80. The arms 84 project upwardly and laterally from the top surface of the cap 80. A hinge or spindle assembly 86 is mountable between the arms 84 for rotatably supporting the lint roll 12.

This configuration enables the lint roll 12 to be employed in a normal manner to remove lint, dust and hair from an article or human. At the same time, the cap 80 which carries the lint roll 12 may be disengaged from the container 82 to enable the contents of the container 82 to be dispensed through a discharge nozzle mounted on one end, not shown, from the container 82.

In the aspect shown in FIG. 7, the cap 80 snaps over an end flange of the container 82. In the aspect of the invention shown in FIG. 8, a container 90 has a smaller diameter cap 92 snapped or threaded onto one end thereof A support 94 is attached to or integrally formed with the cap 92 and carried a pair of spaced arms 96 which have a spindle or shaft 98 extending therebetween. The lint roll 12 is mounted about the shaft 98 for rotation.

Figure 8:
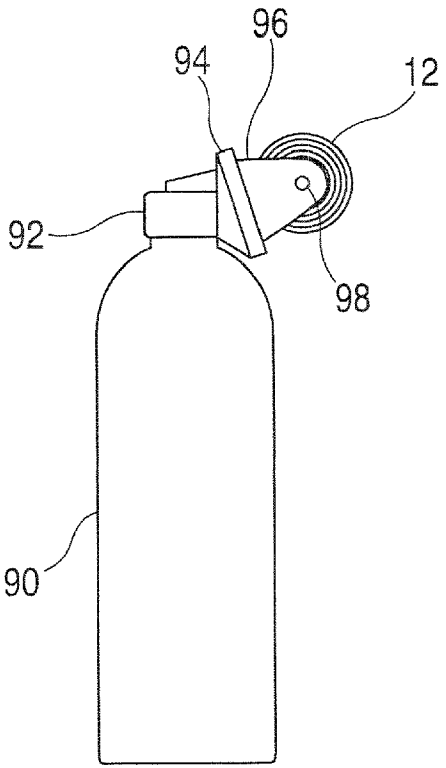
FIGS. 7 and 8 are side elevational view showing yet other aspects of the present invention.

The aspect shown in FIG. 8 functions in the same manner as that shown in FIG. 7 in that the lint roll 12 which is positioned laterally from the outer diameter of the container 90 can be used independent of the discharge of the contents of the container 90. The cap 92 may be removed from the container 90 to enable the discharge of the contents of the container 90 through an outlet in the container or through a discharge nozzle mounted on one end of the container and removably covered by the cap 92.

Figure 9:
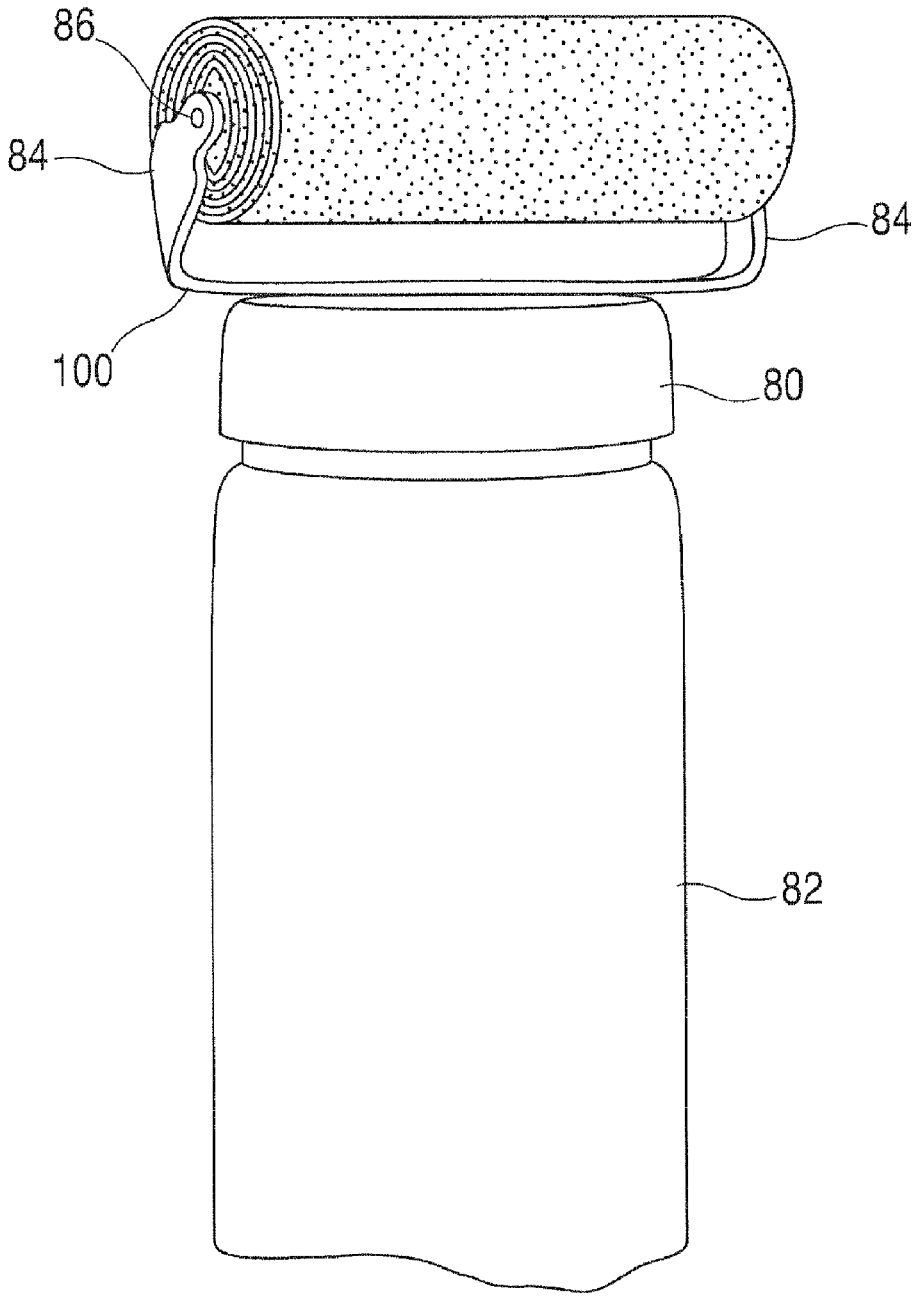
FIG. 9 is a perspective view of another aspect of the present invention.

The aspect of the invention shown in FIG. 9 is similar to that depicted in FIG. 7 except that the arms 84 extend from a base 100 which is integrally molded or attached to the cap by suitable fasteners, adhesive, etc.

Figure 10:
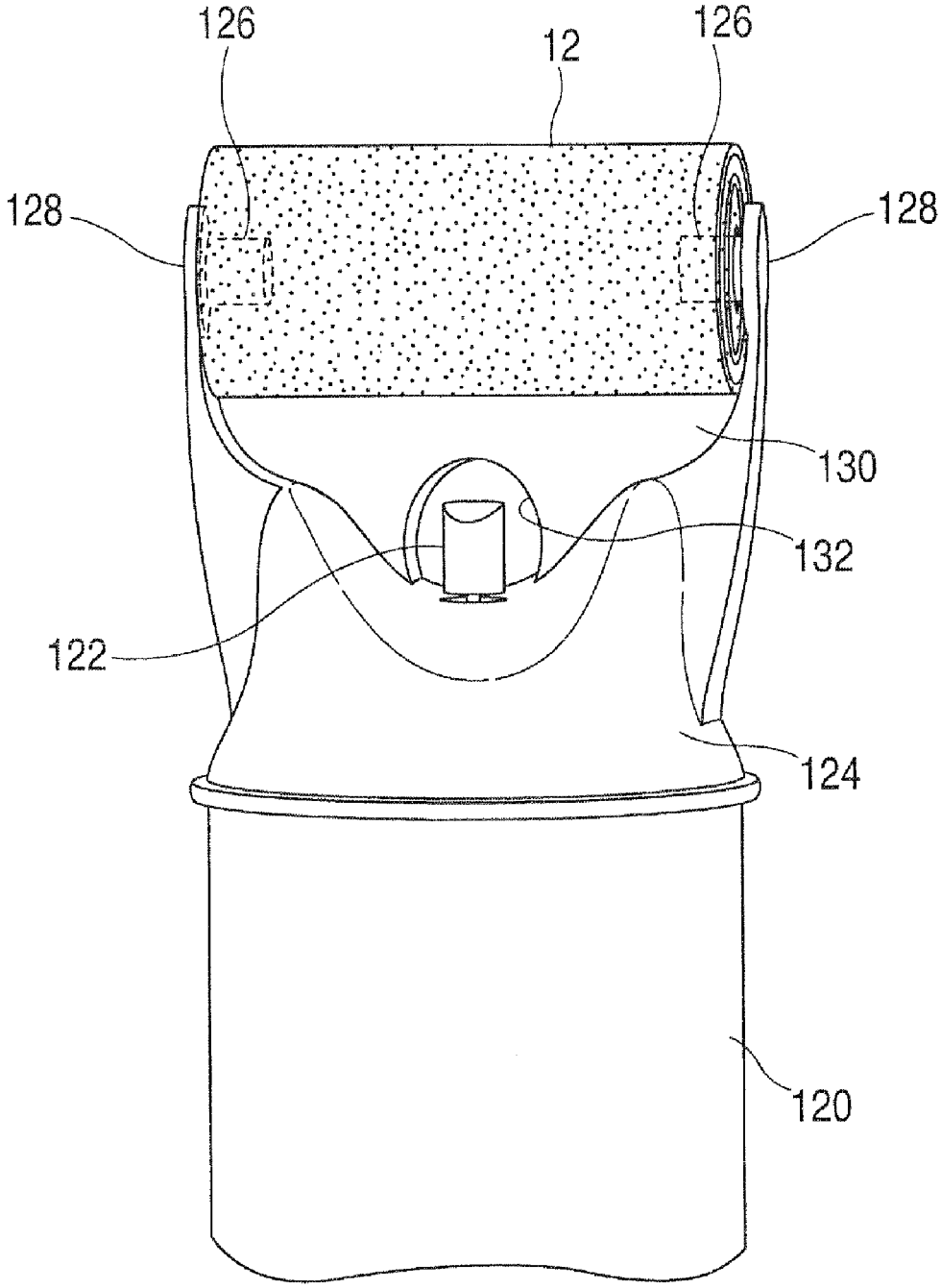
FIG. 10 is a partial, perspective view of yet another aspect of the present invention.

FIG. 10 depicts yet another aspect of the present invention in which an aerosol can 20 has a discharge nozzle 122 mounted on one end and surrounded by a suitably formed gripping cap 124. In this aspect, a lint roll 12 is rotatably supported on pivot points 126 extending inward from a pair of spaced arms 128. The arms 128 extend from a support 130 integrally formed or otherwise attached by adhesive, fasteners, etc., to the cap 124. An aperture 132 is formed in the support 130 adjacent to the outlet of the discharge nozzle 122. This enables the discharge nozzle 122 to be depressed to dispense the contents of the container 120 through the aperture 132 independently or at the same time that the lint roll 12 is being moved across a surface.

The supports 14, 17, 19, 40 and 60 described above for the tape roll 12 could also be attached to or mounted on a cylindrical cap, such as caps 80 or 90.

What is claimed is:

1. A lint roller/fluid dispenser apparatus comprising:
a container containing a cleaning media dispensable from the container;
a lint roll having an adhesive outer surface; and
means for mounting the lint roll on the container comprising:
a hollow support, the support having an inner bore opened from one end, the bore having a diameter for slidably receiving one end portion of the container therein; and
wherein:
one end of the container projects outwardly from the support, after the container is mounted in the support, to act as a handle for use of the lint roll.

2. A lint roller/fluid dispenser apparatus comprising:
a container containing a cleaning media dispensable from the container;
a lint roll having an adhesive outer surface;
means for mounting the lint roll on the container comprising:
a hollow support, the support having an inner bore opened from one end, the bore having a diameter for slidably receiving one end portion of the container therein; and
means for rotatably mounting the lint roll on the support comprising:
a pair of spaced bearing surfaces formed on the support, the lint roll rotatably mounted on the bearing surfaces.

3. A lint roller/fluid dispenser apparatus comprising:
a container containing a cleaning media dispensable from the container;
a lint roll having an adhesive outer surface; and
means for mounting the lint roll on the container comprising:
a hollow support, the support having an inner bore opened from one end, the bore having a diameter for slidably receiving one end portion of the container therein;
a first collar mountable on the container at an intermediate position spaced from one end of the container;
at least one projection carried on the end of the container and spaced from the first collar; and
the lint roll mounted between the projection and the first collar over the container.

4. A lint roller/fluid dispenser apparatus comprising:
a container containing a cleaning media dispensable from the container;
a lint roll having an adhesive outer surface; and
means for mounting the lint roll on the container comprising:
a spindle having opposed first and second end collars; and
at least one of the first and second end collars having a through aperture for mounting of the spindle over a portion of the container.

5. A lint roller/fluid dispenser apparatus comprising:
a container containing a cleaning media dispensable from the container;
a lint roll having an adhesive outer surface; and
means for mounting the lint roll on the container comprising:
a hollow tubular support, the support having an inner bore opened from one end, the bore having a diameter for slidably receiving one end portion of the container therein;
means carried on the support for rotatably mounting the lint roll on the support; and
means, carried on the support, for releasibly mounting one end of the support on to the container.

6. A lint roller/fluid dispenser apparatus comprising:
a container containing a cleaning media dispensable from the container;
a lint roll having an adhesive outer surface; and
means for mounting the lint roll on the container, said mounting means comprising:
a hollow support, the support having an inner bore opened from one end, the bore having a diameter for slidably receiving one end portion of the container therein,
a cap mountable over a discharge end of the container; and
means, carried on the cap, for supporting the lint roll on the cap.

7. The apparatus of claim 6 wherein the rotatable mounting means comprises:
a pair of spaced arms carried on the cap, the lint roll rotatably disposed between the pair of arms.

8. A lint roller/fluid dispenser apparatus comprising:
a container containing a cleaning media dispensable from the container;
a lint roll having an adhesive outer surface; and
means for mounting the lint roll on the container comprising:
a hollow support, the support having an inner bore opened from one end, the bore having a diameter for slidably receiving one end portion of the container therein, and
wherein the apparatus further includes:
a discharge nozzle carried on one end of the container;
the mounting means including a support mounted on one end of the container;
a pair of arms projecting from the support and rotatably carrying the lint roll therebetween; and
an aperture formed in the support adjacent to the discharge nozzle to allow dispending of the contents of the container through the discharge nozzle and the support.

* * * * *